United States Patent [19]

Cain et al.

[11] 4,232,540

[45] Nov. 11, 1980

[54] CONTROLLED VARIABLE RADIUS ROLL FORMING APPARATUS

[76] Inventors: Jack C. Cain, 536 S. Waterman Ave., Arlington Heights, Ill. 60004; Maynard E. Carlson, Rte. 1, Carlson Rd., Box 289, West Salem, Wis. 54669

[21] Appl. No.: 21,798

[22] Filed: Mar. 19, 1979

[51] Int. Cl.[3] ..... B21D 5/14; G01B 5/20

[52] U.S. Cl. ..... 72/11; 72/17; 72/21; 72/173

[58] Field of Search ..... 72/6–12, 72/21, 17, 173

[56] References Cited

U.S. PATENT DOCUMENTS

| | | | |
|---|---|---|---|
| 2,325,523 | 7/1943 | Lermont et al. | 72/173 |
| 3,906,765 | 9/1975 | Foster | 72/9 |
| 3,955,389 | 5/1976 | Foster | 72/9 |
| 4,047,411 | 9/1977 | Foster | 72/7 |

*Primary Examiner*—Milton S. Mehr
*Attorney, Agent, or Firm*—Darbo & Vandenburgh

[57] ABSTRACT

A roll forming apparatus for curling a sheet of metal into a curved configuration having a plurality of sheet contours which apparatus automatically and sequentially varies the degree of curvature of a sheet of metal being treated by the apparatus as the sheet progresses through the apparatus. The apparatus includes a pair of pinch rolls and a bending roll for curving the sheet into predetermined arcs dependent upon the relative positions of the bending and pinch rolls, and a control mechanism to alter the relative positions of the bending and pinch rolls for each of a successive plurality of segments of the sheet as it travels through the apparatus. The control mechanism includes means to sense the actual distance the sheet has progressed through the roll forming apparatus and to compare the actual distance with one or more pre-established distances of sheet travel at which the radius of curvature of the sheet is to be changed. Responsive to the comparison, the control mechanism then varies the position of the bending roll relative to the pinch rolls to effect changes in the contour of the sheet being roll formed.

16 Claims, 6 Drawing Figures

CONTROLLED VARIABLE RADIUS ROLL FORMING APPARATUS

SUMMARY OF THE INVENTION

THE BACKGROUND

This invention relates to a forming apparatus for bending sheet metal into a variety of different cross-sectional shapes having a plurality of sheet contours included in each shape, and more specifically to an apparatus for forming corrugated metal sheets into pipe culverts of non-circular cross-section.

Machines for bending sheet metal into tubes or other shapes have been used for many years and are well known. Companies such as the Stamco Division of Monarch Machine Tool Co., located in New Bremen, Ohio, have been manufacturing forming apparatus for bending plain or corrugated sheet metal into cylindrical configurations, known as "cans," for more than 50 years. The typical can is formed of a single curved sheet or, for cans of a larger diameter, a plurality of curved sheets joined together.

In a conventional apparatus for forming metal cans, a sheet of plain or corrugated metal is passed between a pair of rolls, often called pinch rolls, which guide and drive the sheet as it progresses through the apparatus. A forming or buttress roll is located downstream in the apparatus and provides the proper degree of curvature to form the sheet metal into the can, or portion of the can, of a desired diameter. An example of a similar apparatus employing three rolls for metal bending, although not specifically for sheet metal, is U.S. Pat. No. 965,171. After the metal is rolled, two edges are joined to form a length of metal pipe. Conventional means of spot welding or riveting may be used.

Often, however, a user desires to change the shape of the formed pipe after it has been made to accommodate different liquid flow characteristics or adapt the pipe to fit particular specifications calling for pipe which is other than circular. A common example is "pipe arch" often used as highway culverts and shown and discussed, for example, in "Handbook of Drainage And Construction Products," published by Armco Drainage and Metal Products, Inc., Middletown, Ohio, in 1958 and in preceding and succeeding years.

Pipe arch and other pipe shapes have, in the past, been formed in one of two manners, both starting with a length of circular pipe. The first, and most common, is formation of the pipe arch in an apparatus which has exterior forming dies conforming to the desired ultimate shape of the pipe arch. A length of circular pipe is placed in the pipe arch device and the device then closed to squash the circular pipe, conforming it to the shape of the arching dies. Other manufacturers have used internal dies which are expanded within the circular pipe to deform it into the desired configuration. A serious deficiency of this type of equipment is the need for a separate set of dies for each size of pipe arch to be manufactured, and therefore the encumbent substantial cost. A further disadvantage is that it is not uncommon for localized excessive bending (creasing or kinking) to occur with the result that the galvanizing is broken loose in those locations.

Another disadvantage with the prior art methods of forming contoured pipe is encountered when it is necessary to join several lengths of the pipe to form a long culvert, etc. The pipe arch, or other non-circular shape resulting from the forming procedure, is not identical every time. Thus, often a series of cans so formed do not align properly and are difficult, if not impossible, to properly join.

An automatic machine for roll forming of metal parts is disclosed in U.S. Pat. No. 3,955,389. This machine continually senses the contour of the emerging portion of a part being formed, compares the emerging coutour with that desired, and continuously permits alteration of the forming operation to compensate for metal springback. The disclosed machine and process provides continuous "after-the-fact" monitoring to see that tolerances, which are critical in the aircraft industry, are closely met. Similar machines are disclosed in U.S. Pat. Nos. 3,906,765 and 4,047,411.

The automatic machines described in the foregoing patents, however, are highly complex and, consequently, expensive to construct and maintain. Thus, although they possibly are suitable for industries requiring close tolerances and therefore relatively expensive per part costs, they are not suitable for formation of more durable and less expensive products of lesser tolerance requirements, such as culvert pipe.

A substantial deficiency of the prior art in general has been the lack of a simple and effective machine for automatically and continuously producing a curved metal sheet of a plurality of sheet contours which is able to sense the distance the sheet being formed has travelled and, at discrete travel positions, effect changes in the degree of curvature impressed into the sheet. Automatic controls for other applications, such as those for numerically-controlled machine tools, are complex and not adaptable without excessive cost and ingenuity to control apparatus such as the above-discussed U.S. Pat. No. 3,955,389.

Other advantages of the disclosed embodiment are: the system is immune to electrical "noise" resulting from the fact that it requires continuous parallel data; and the drive of the rolling machine can be stopped and temporarily reversed during the process of rolling a sheet since the counters employed will count either up or down.

THE INVENTION

The present invention overcomes the above deficiencies of the prior art and others by providing a simple, controlled three-roll apparatus for forming a sheet of metal into curved configurations having any one of an almost limitless plurality of sheet contours, while maintaining a high degree of accuracy and repeatability during curling of the sheet. The apparatus can be used with a minimum of operator intrusion, therefore reducing the possibility of human error.

In accordance with the invention, a conventional apparatus having a pair of pinch rolls and a bending roll for curving a sheet of metal into predetermined arcs depending upon the relative positions of the bending and pinch rolls is improved by including in the apparatus means to sense the actual distance the metal sheet has progressed through the roll forming apparatus and to generate a signal indicative of the actual distance the sheet has travelled. This signifies which segment of the sheet is in the process of being bent. At the same time, signals related to one or more pre-established distances of sheet travel, where the relative positions of the bending and pinch rolls are to be altered, are compared with the signal indicative of the actual distance of sheet travel and a further signal resulting from the comparison is generated. This signal will identify which segment of the sheet is in the position to be bent. The apparatus includes a radius control circuit having a plurality of channels, with each channel being programmable to establish the relative positions of the rolls to produce a bend of a predetermined radius. Said further signal, dependent upon the results of the comparison, dictates which channel of the radius control circuit is activated. Depending upon which is activated, the position of the bending roll relative to the pinch rolls is established to be appropriate for the segment of the sheet. Therefore, the contour of the sheet is progressively altered to achieve the result desired.

In accordance with the preferred embodiment of the invention, the distance which the sheet travels through the apparatus is sensed by a wheel bearing against the sheet as it proceeds between the pinch rolls. An encoder connected to the wheel directs electrical signals to a digital counter which generates a binary representation of the actual distance the sheet has travelled.

The apparatus also includes command generator means to store values of each of a plurality of pre-established distances of sheet travel, each distance relating to a position where the sheet curvature is to be changed from that of the preceding sheet segment. The stored values are translated into binary representations of each of the pre-established distances of travel. While the disclosed embodiment advantageously does this in digital form, it will be apparent to those in the art that analog embodiments also may be used.

The binary representations of actual sheet travel and pre-established distances of sheet travel are compared in the means to compare, which preferably includes a separate comparator associated with each of the pre-established distances of sheet travel. Each comparator is capable of producing one of three output signals, one signal being indicative of the actual distance travelled being less than the associated pre-established distance, the second being indicative of the actual distance travelled being equal to the associated pre-established distance, and the third being indicative that the actual distance is greater than the associated pre-established distance.

A gating circuit receives the output signals from the comparators, producing a signal indicative of the distance travelled and thus of the sheet segment that is in the bending location, this signal being changed each time the actual distance that the sheet has progressed equals one of the pre-established distances of sheet travel. The distance indicative signals are directed to the radius control circuit, where the signals are used to activate one of the channels thereof. Depending upon which channel is activated, a servo is adjusted to control the position of the bending roll relative to the pinch rolls to a desired selectable preset position.

The procedure of distance detection and modification of the position of the bending roll is continued until the final pre-established distance of sheet travel has been reached, at which the operation of the gating circuit is inhibited and the bending roll is caused to move out of bending engagement with the surface of the sheet being roll formed.

The features of the invention will become more readily apparent in the following detailed description of the invention when taken in conjunction with the accompanying drawings.

DETAILED DESCRIPTION OF THE INVENTION

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
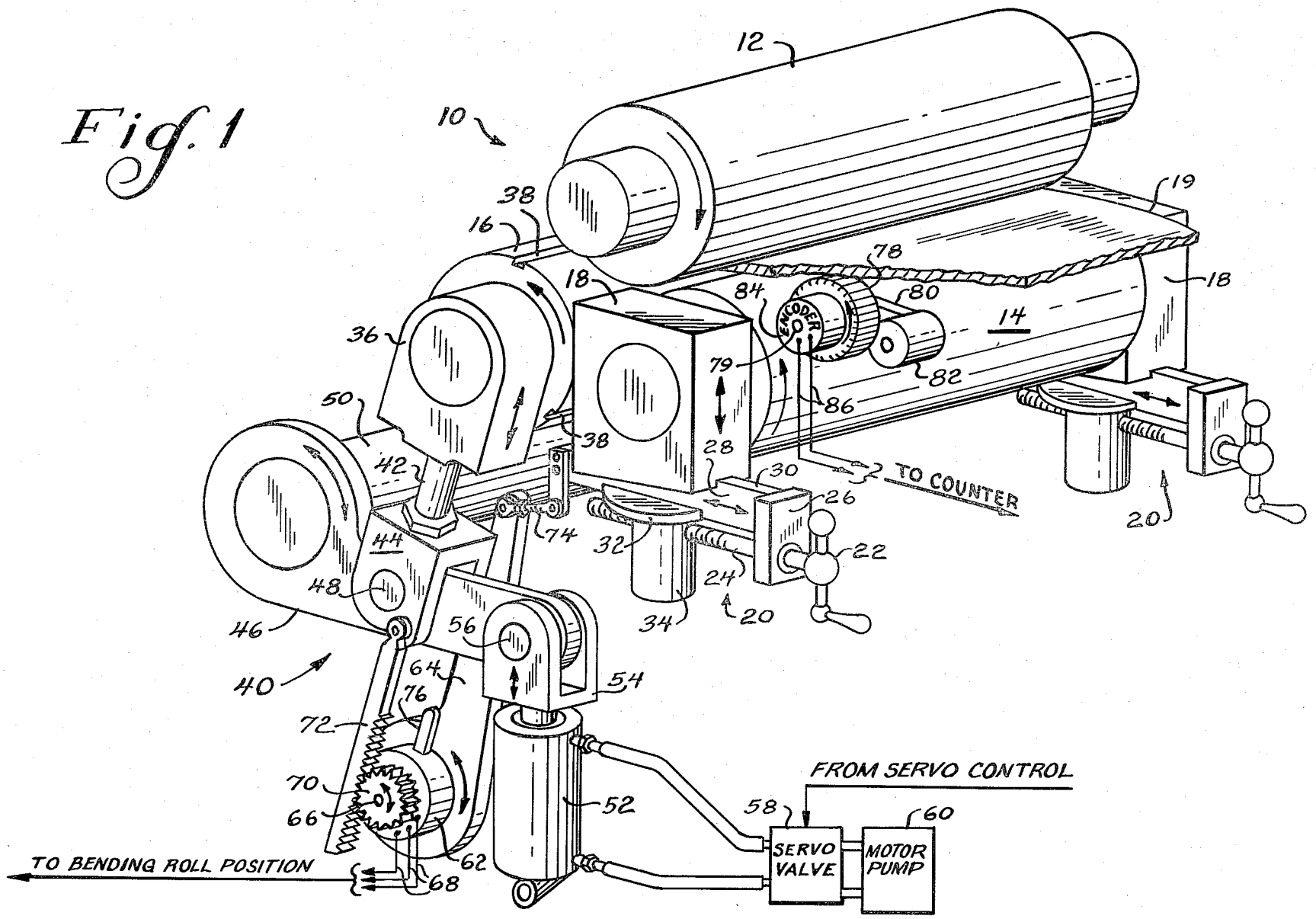
FIG. 1 is a schematic illustration of a bending apparatus embodying the invention with portions omitted for clarity.
Figure 2:
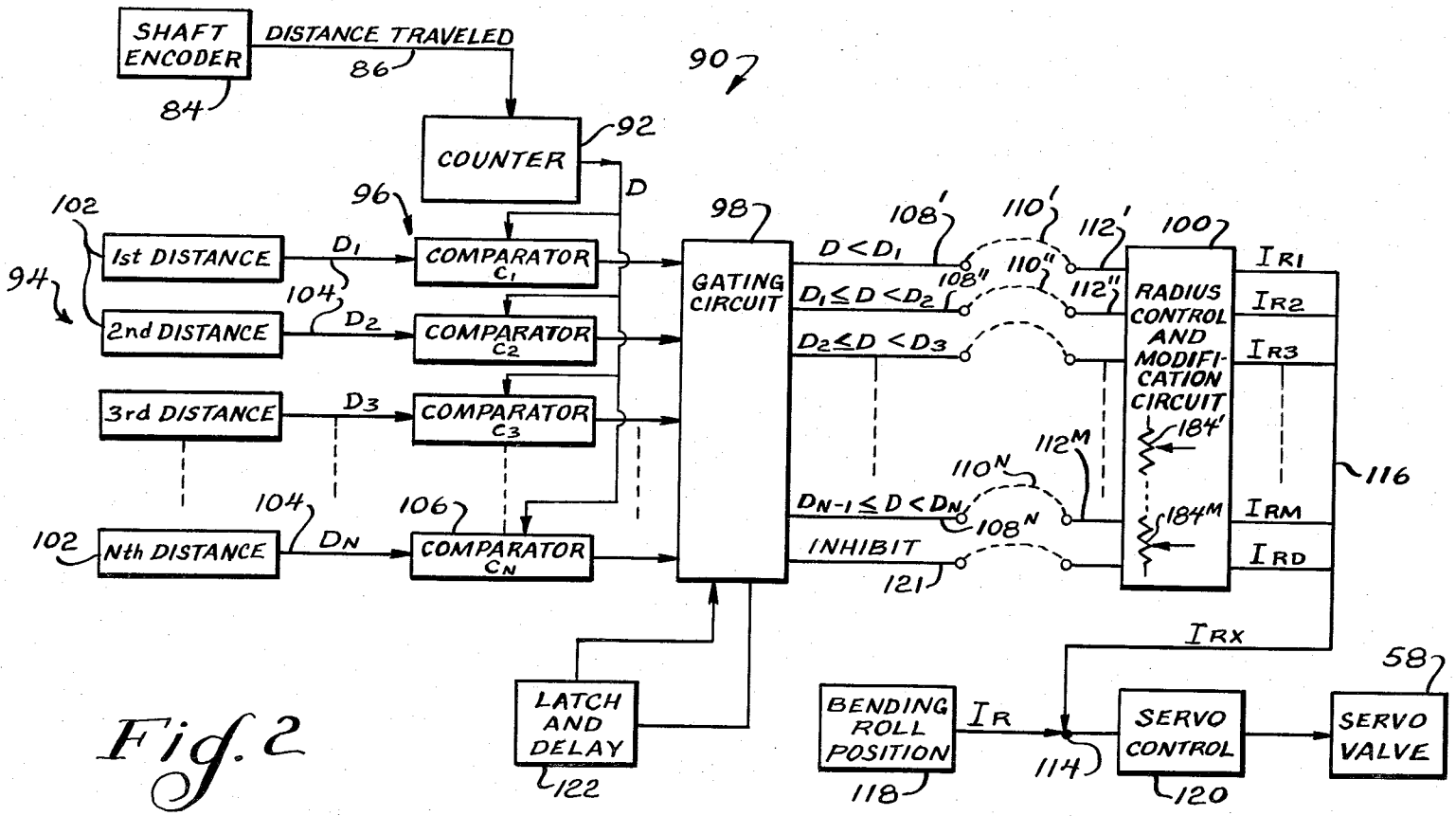
FIG. 2 is a block diagram illustrating the control mechanism of the invention.
Figure 3:
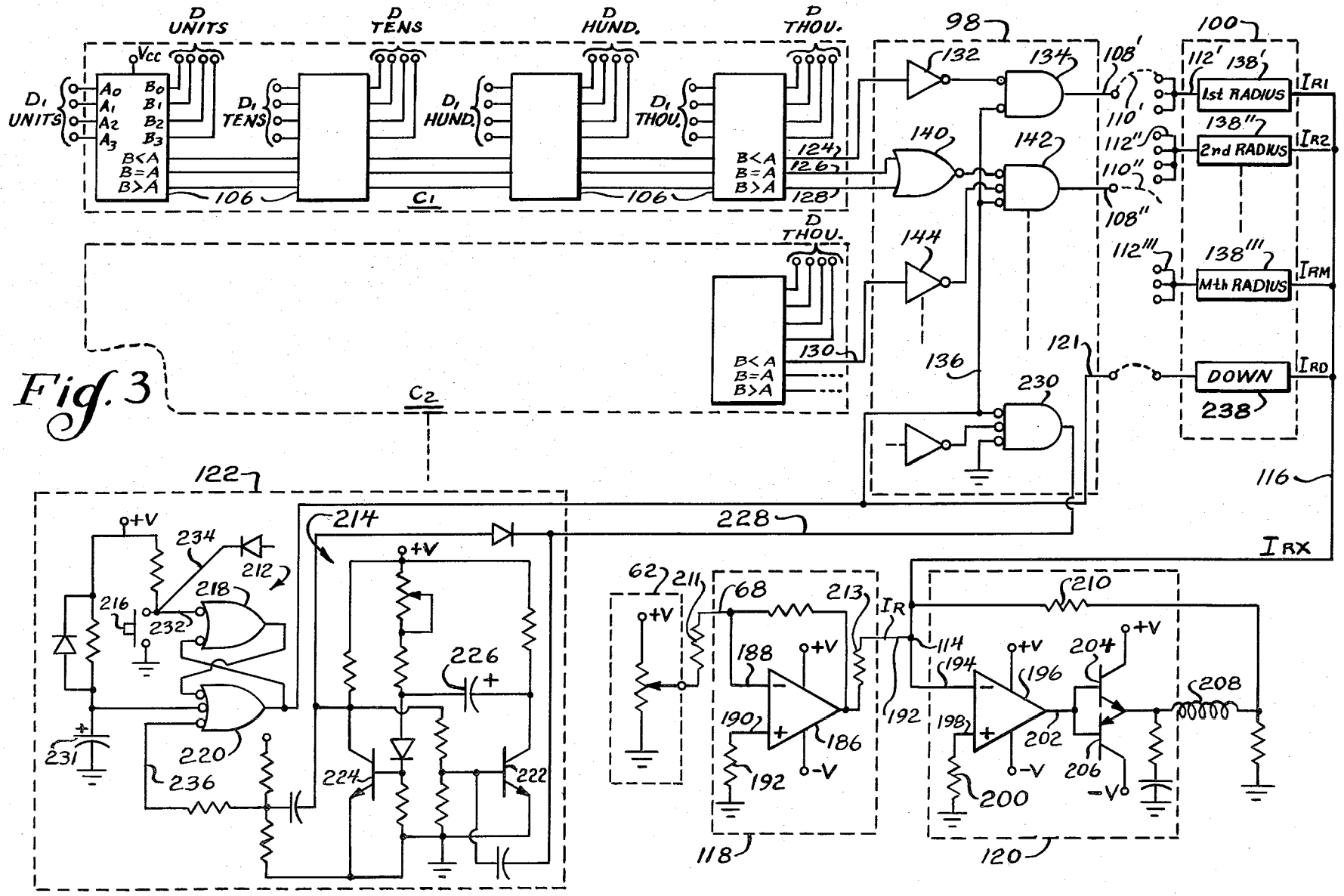
FIG. 3 is a circuit diagram for portions of the block diagram of FIG. 2.
Figure 4:
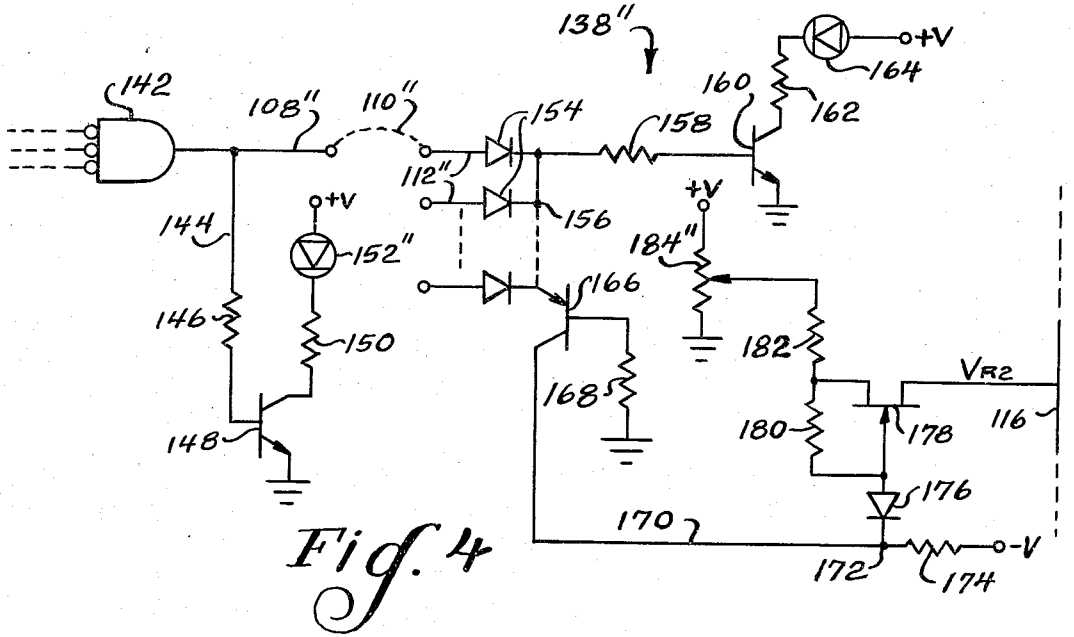
FIG. 4 is a circuit diagram for a typical sheet radius of curvature control and modification circuit.

A roll forming apparatus according to the invention is shown generally at 10 in FIG. 1. It includes a pair of pinch rolls 12 and 14 and a bending roll 16, the position of which is controlled by a control mechanism (FIGS. 2–4). For bending corrugated sheets of metal into corrugated pipe, the rolls would have their peripheries formed to fit the corrugations, but this common detail is not illustrated. The rolls are connected to a suitable power drive (not shown) to rotate the rolls and thus drive the metal sheet through the bending apparatus.

The pinch roll 14 is shown mounted in a pair of journal blocks 18 which permit rotation of the roll 14. The blocks 18 are mounted in ways (not illustrated) in the frame of the apparatus (also not illustrated) to permit vertical alignment of the roll 14 in relation to the roll 12.

Similar to the roll 14, the roll 12 is mounted in journal blocks (not illustrated) which permit rotation of the roll and which are mounted in the frame of the apparatus. Typically, the journal blocks for the roll 12 are fixed to the frame rather than slideable as the journal blocks 18 of the pinch roll 14. However, and as is well known with this type of apparatus, the pinch roll 12 is pivotally mounted to allow one end thereof to be raised so that the "can" formed in the apparatus may readily be removed when finished.

Since varying thicknesses of sheet material 19 are typically roll formed by the apparatus 10, the spacing between the pinch rolls 12 and 14 must be variable to accommodate varying thicknesses of the sheets to be rolled. Accordingly, adjustment mechanisms, generally 20, are provided for each of the journal blocks 18. Each mechanism 20 includes a handwheel 22 attached to a horizontal threaded rod 24, both of which are fixed for rotation only relative to the frame of the apparatus by means not illustrated. The rod 24 passes through a plate 26 which is welded to an elongated bar 28 having an inclined top surface 30 which engages a way formed in the bottom of the journal block 18. The bottom of the bar 28 is notched to accommodate a top plate 32 of a cylinder 34 through which the rod 24 is threadedly engaged. Therefore, as the bar 28 is adjusted by rotation of the handwheel 22, the journal block 18 is raised or lowered within its way in the frame of the apparatus depending on the direction to which the bar 28 is adjusted.

The bending roll 16 is mounted at each end for rotation in journal blocks 36. The blocks 36 in turn are mounted in inclined ways (not illustrated) in the frame of the apparatus to allow adjustment of the bending roll 16 relative to the pinch rolls 12 and 14.

Although not illustrated, the rolls 12, 14 and 16 are typically driven by a motor mounted in the frame of the apparatus in order to form a sheet of metal into a curved configuration as it passes from right to left between the pinch rolls 12 and 14 into engagement against the bending roll 16. A chain or gear linkage between the motor and the roll(s) may be utilized to rotate the rolls in proper directions as indicated in FIG. 1.

When a sheet of metal is curled into a curved configuration having a small radius of curvature, the bending roll 16 is brought into close proximity to the pinch rolls 12 and 14. Often, with the bending roll 16 close to the rolls 12 and 14, initial feeding of a metal sheet into the apparatus is extremely difficult, especially when a sheet of heavy gauge material is to be curled. The sheet often is clamped between the pinch rolls 12 and 14 and butts into the side of the bending roll 16, and the rolls spin without forcing the sheet between them. Therefore, the bending roll 16 is provided with a series of longitudinal grooves 38 which eliminate this problem by engaging the end of a sheet as it butts against the rolls 16 and initially directing the sheet into its curved configuration. Preferably, three grooves are used, spaced equally at 120° intervals about the circumference of the bending roll 16.

An adjustment mechanism, generally 40, is employed to adjust the position of each of the journal blocks 36 in its way in the frame of the apparatus. The mechanism 40 includes a rod 42 which is securely engaged in the bottom of the block 36. The rod 42 is also attached to a U-shaped bracket 44 which is pivotally attached to an arm 46 by a pin 48. Arms 46 are attached to a rod 50 which is fixed to the frame of the apparatus. The rod 50 correlates the movement of the two arms 46 for raising and lowering of the blocks 36 within its ways in the frame of the apparatus.

Arms 46 are adjusted, thereby raising or lowering the bending roll 16, by means of a double acting hydraulic cylinder 52 attached to one of the arms 46 by a bracket 54 and pin 56. Fluid pressure in the cylinder 52 is controlled by a servo valve 58 which is in turn controlled by a servo control (FIG. 2) described in greater detail below. A motor pump 60 provides constant fluid pressure to the servo valve 58.

In connection with the control mechanism described below with regard to FIGS. 2 through 5, it is necessary to maintain an accurate record of the position of the bending roll 16 relative to the position of the pinch rolls 12 and 14. To this end, a potentiometer 62 is used to provide a signal to the control mechanism indicative of the bending roll position. The potentiometer 62 is attached to a pivotally mounted arm 64 which has its pivot axis concentric with the axis of the potentiometer shaft 66. Wires 68 provide electrical signals from the potentiometer 62 to the control mechanism as described in greater detail below.

The potentiometer senses the position of the bending roll 16 by means of a pinion 70 on shaft 66, which pinion engages a rack 72 pivotally attached to the bracket 44. As the position of the bending roll 16 is altered, the teeth of the rack 72 cause the pinion 70 to rotate, thereby changing the setting of the potentiometer 62 (i.e., the movement of the slider thereof along the resistor thereof—see FIG. 3).

Since the curvature of a sheet of metal being bent by the apparatus 10 is also affected by the thickness of the sheet, the spacing of the pinch rolls 12 and 14 must also be monitored. Hence, the arm 64 is attached to the bar 28 by a linkage 74. As the adjustment mechanism 20 is changed, the linkage 74 pivots the arm 64 about its pivot axis, rotating the body of the potentiometer 62 in relation to the pinion 70 (i.e., moving the potentiometer resistor along its slider), causing the output of the potentiometer along the wires 68 to be changed.

The potentiometer 62 is fixed to and pivots with the arm 64. However, often fine initial adjustment of the potentiometer is necessary in order to accommodate slight variances of thickness of sheet metal entering the equipment which is of the same gauge. Therefore, the housing of potentiometer 62 is releasably affixed by means (not shown) to the arm 64 and is provided with a lever 76 which allows rotation of the housing of the potentiometer 62 about the axis of shaft 66 in relation to both the arm 64 and the pinion 70. This causes the potentiometer resistor to move with respect to the slider thereof. Following such initial adjustment, however, the potentiometer again is fixed to the arm 64 and prevented from further rotation relative to the arm.

An important feature of the invention is detection of the distance which a sheet of metal has progressed through the apparatus in order to effect a change of the position of the bending roll 16 to achieve curvature of the sheet desired for the next segment thereof. To detect the distance, a wheel 78 of known diameter is used, engaging the underside of the sheet 19 as it passes between the pinch rolls 12 and 14. The wheel 78 is mounted for rotation on a shaft 79 secured to the distal end of an arm 80 extending from a proximal end 82 of the arm, which proximal end is pivotally attached to the frame of the apparatus. The arm 80 is spring loaded so that the wheel 78 is urged against the sheet as it progresses between the pinch rolls 12 and 14. Thus the wheel 78 does not slip, which slipping would cause false readings of the actual distance travelled.

Also mounted on shaft 79 and attached to the wheel 78 is a shaft encoder 84 which monitors the extent of rotation of the wheel 78 and provides electrical signals representing distance of sheet travel, which signals are conducted by wires or line 86 to a counter in the control mechanism, described in greater detail below. Hence, the actual distance the sheet has progressed through the roll forming apparatus is continually sensed so that appropriate commands may be given to the servo valve 58 to activate the cylinder 52 and thereby alter the position of the bending roll 16 relative to the pinch rolls 12 and 14.

The control mechanism, generally 90 of the invention is depicted in a block diagram in FIG. 2. It includes, as major components, a digital counter 92, a plurality of command value generators or pre-established distance recording devices, generally 94, a series of comparators, generally 96, a gating circuit 98, and a radius control and modification circuit 100.

Counter 92 accepts the electrical signals from the shaft encoder 84 along the line 86. Typically, the shaft encoder 84 will provide electrical pulses to the counter 92 as the wheel 78 rotates. Each pulse is indicative of a predetermined amount of rotation of the wheel 78, and therefore signifying that a predetermined amount of the sheet has travelled through the apparatus 10. The counter 92 continually counts the pulses and therefore provides a binary representation of the actual distance the sheet has travelled. This counter commences only after the sheet 19 enters the nip between the pinch rolls 12, 14.

Figure 6:
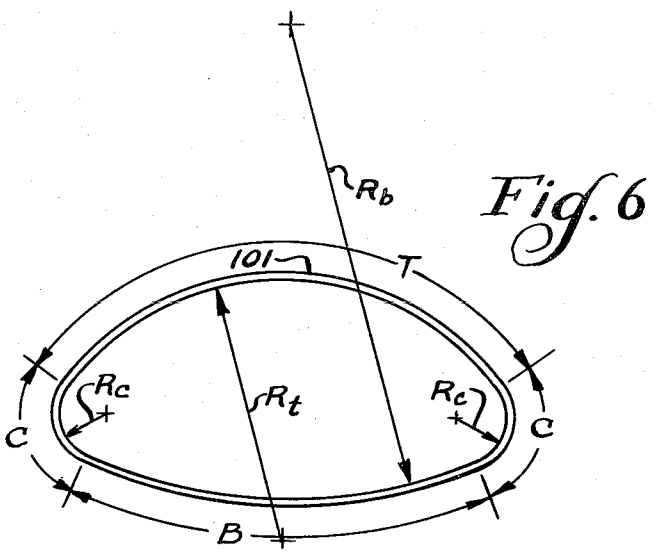
FIG. 6 is a cross-sectional view of a pipe arch or culvert that may be rolled by the apparatus of the invention.

In accordance with the invention, at one or more preestablished distances of sheet travel through the apparatus 10, the position of the bending roll 16 is changed to that appropriate for the curvature of the metal sheet in the next succeeding segment thereof. For example, FIG. 6 illustrates a typical pipe arch or culvert 101 manufactured in accordance with the specifications of the National Corrugated Steel Pipe Association and having three different radii of curvature. The top of the pipe arch comprises a segment T of the original sheet which has been bent to have a particular radius of curvature $R_t$, the bottom is a segment B having a different and greater radius of curvature $R_b$, and the junctions between the top and bottom of the pipe arch are segments C having yet a different radius of curvature $R_c$. Therefore, if the three radii of curvature $R_t$, $R_b$ and $R_c$ are impressed into particular segments T, B and C of the sheet, the sheet will be formed into a culvert of the desired configuration.

It will be apparent to those in the art that other cross-sectional configurations may be rolled. For example, a generally rectangular, or triangular, configuration with rounded corners may be produced. In such a configuration a straight side would be considered to have a radius of curvature of infinity.

Assuming that the top portion of the pipe arch of FIG. 6 is first impressed into the sheet, a particular radius $R_t$ is effected by proper location of the bending roll 16 relative to the pinch rolls 12 and 14. After a first pre-established distance which determines the demarcation between that initial segment and the next successive segment, a connecting curvature $R_c$ is then impressed in the sheet for a second pre-established distance. Thereafter, the radius of curvature appropriate for the sheet segment to be the bottom of the pipe arch, $R_b$, is impressed into the sheet for yet another predetermined distance. Then, a connecting curvature $R_c$ is impressed into the sheet for yet another predetermined distance, completing the pipe arch configuration. Thereafter, the curled sheet is removed from the apparatus 10 by raising the pinch roll 12, and the juncture of the two ends of the sheet is conventionally riveted or spot-welded. Hence, a minimum of four pre-established distance measurements must be known in order to manufacture pipe arch.

In actual practice it is preferable to start not with an end of the top portion, but rather at an intermediate location in the segment of the sheet which is to form top or bottom. Then there is a final, fifth, distance measurement during which the remainder of the top, or bottom as the case may be, curvature is rolled. This procedure aids in the final assembly of the culvert.

Distances which identify the demarcation between adjacent segments having different radii of curvature are loaded into the pre-established distance recording device 94, which serves as command value generator means. Separate distance recording units (command value generators) 102 are used to record each preestablished distance at which a change in the radius of curvature is to be made. Preferably, for user simplicity, the preestablished distances are entered into the recording units 102 in a decimal form, but, for calculation purposes, the outputs of the units 102 are provided in binary or binary coded decimal form. A counter corresponding to that used in the "English/Metric Digital Readout Micrometer" manufactured by C & G Associates of Elk Grove Village, Ill. has been used by the applicant for the recording unit.

The outputs $D_1$ through $D_N$ of the recording units 102 are provided on lines 104 to associated comparators $C_1$ through $C_N$. Each comparator $C_1$ through $C_N$ is also provided with the electrical signal indicative of the actual distance D the sheet has travelled through the nips of the pinch rolls as determined by the counter 92. The comparators $C_1$ through $C_N$ compare the actual distance D with the pre-established distances $D_1$ through $D_N$ and generate a signal to the gating circuit 98 responsive to the comparison.

The gating circuit 98, as indicated in FIG. 2, provides, on the outputs represented by separate lines 108' through 108$^N$, output signals indicative of the status of the actual distance travelled as compared to the pre-established distances set in the recording units 102. An electrical signal will be generated on only one of the lines 108' through 108$^N$ respectively when the actual distance the sheet has travelled through the apparatus 10 is greater than or equal to the distance for which the respective recording unit 102 has been set and less than the distance for which the next successive recording unit has been set.

Each of the lines 108' through 108$^N$ is connected to one of the inputs of the radius control and modification circuit 100 by a series of leads 110' through 110$^N$ connected to lines 112' through 112$^M$ respectively representing inputs of the control and modification circuit 100. Since, as indicated above, a particular radius of curvature may be duplicated two or more times during curling of the sheet of metal, more than one of the lines 108' through 108$^N$ may be connected by the leads 110' through 110$^N$ to one of the lines 112' through 112$^M$, as will be described in greater detail below in connection with the description of the detailed circuitry shown in FIG. 3.

The radius control and modification circuit has a plurality of channels, all of which have a common output (line 116), but each having its own input (112', 112'', etc.). Each channel (one being represented in FIG. 4) includes a command generator means (the command generator means for the various channels being potentiometers 184–184M) by which a particular radius may be set. Depending on the actual distance travelled and thus which input is receiving a signal, a particular one of the channels of the radius control and modification circuit is activated to generate a specific output current dictated by the setting of the potentiometer (the output currents of the various channels being $I_{R1}$–$I_{RM}$). The output current of the activated channel is passed through a line 116 to a summing junction 114 which is also provided with a current $I_R$ from a bending roll position indication circuit 118, described in greater detail below. The signal from the activated channel to the summing junction is indicative of what is to be the relative positions of the rolls to produce a particular radius of curvature of the metal sheet. The summing junction 114 is connected to a servo control 120 which, responsive to the result of the current summation, controls the servo valve 58 to in turn dictate the position of the bending roll 16.

Also included in block form in FIG. 2 is a latch and delay circuit 122 which is connected to the gating circuit 98 and also a line 121 leading to the radius control and modification circuit 100. The latch and delay circuit enables operation of the control mechanism 90 and, as described below in greater detail, delays inhibition of the control mechanism for a desired time after the sheet forming operation has been completed.

FIG. 3 shows one form of the circuitry for the control mechanism 90 shown in block form in FIG. 2. For ease of explanation, the applicant has chosen and depicted positive logic transistor/transistor logic (TTL), although it will be understood that other logic, such as diode/transistor logic (DTL) and others, may equally well be used.

Each of the comparators $C_1$ through $C_N$ (only one of which, $C_1$, is completely shown) is composed of four cascaded comparator units 106. The particular comparator units illustrated are Number SN74LS85 4-bit magnitude comparators manufactured by Texas Instruments, Incorporated of Dallas, Tex.

In operation, each comparator unit 106 of the comparator $C_1$ accepts from the counter 92 a binary representation of the actual distance travelled. The comparator units 106 also accept from the first of the recording units 102 a binary representation of the first pre-established distance at which a change of the curvature of the sheet is to be effected. In this particular embodiment of the invention, the applicant has chosen the inputs to each of the comparator units to be in binary coded decimal form. Each of the inputs to the comparator units representing units, tens, hundreds and thousands must be provided on four leads to each of the units 106, as shown.

Each of the comparators $C_2$ through $C_N$ is identical to the comparator $C_1$. Each accepts the binary coded decimal form of the actual distance travelled and the pre-established distance desired from each of the associated distance recording units 102. Therefore, the remainder of the comparators $C_2$ through $C_N$ have been omitted from FIG. 3 as redundant as far as the explanation is concerned.

The output of the comparator $C_1$ emanates from the fourth of the cascaded comparator units 106 on three lines 124, 126 and 128. As shown, the first output on line 124 indicates the comparison result that the actual distance travelled is less than the first pre-established distance loaded in the first distance recording unit 102. The output on the line 126 indicates that the actual distance travelled equals the pre-established distance loaded in the associated recording unit 102, while the output on the line 128 indicates that the actual distance travelled is greater than the pre-established distance recorded in the unit 102. Outputs of each of the comparators $C_2$ through $C_N$ are similar, and are therefore omitted save one output on line 130 from the fourth comparator unit of the comparator $C_2$, indicating that the pre-established distance $D_2$ is greater than the actual distance D travelled, which is necessary for the purposes of understanding the operation of the gating circuit 98.

Only one of the three outputs of each of the comparators $C_1$ through $C_N$ is activated at any one time. Its voltage level output will be high, while the remainder of the outputs is low.

When the output on the line 124 is high, that is when the actual distance D is less than the pre-established distance $D_1$, the output is inverted by an inverter 132 and presented to an inverting input AND-gate 134. An enablement signal is also received by the gate 134 along the line 136 leading from the latch and delay circuit 122. The voltage level on line 136, which is described in greater particularity below, is normally low. Therefore, the gate 134 produces a high output on the line 108' which in turn is directed by the lead 110' to the first radius generating circuit 138 of the radius control and modification circuit 100.

At the same time, outputs on the lines 126 and 128, which are directed to a NOR-gate 140, are low, causing the output of the NOR-gate 140 to be high and therefore causing the output of an inverting input AND-gate 142 connected to the NOR-gate 140 to be low. Hence, no electrical signal is found on the line 108'' and subsequent of the lines 108''' through 108$^N$.

When a high output is generated on line 126 indicating that the actual distance travelled equals the pre-established distance $D_1$, the NOR-gate 140 produces a low output. At the same time, since the actual distance travelled is less than the pre-established distance $D_2$, there is a high output on the line 130 which is inverted by an inverter 144 and presented to the gate 142. Thus, all three inputs to the gate 42 are low, and therefore there is a high output on line 108''. However, since now the output on line 124 is low, the inverter 132 presents a high output to the gate 134, and therefore the output on line 108' is low. Hence, an output signal is found only on the line 108''. It will be seen that, therefore, as the actual distance D increases and is compared with the pre-established distances $D_1$ through $D_N$, only one output of the gating circuit 98 will be possible, and, as shown in FIG. 2, such output will exist so long as the actual distance travelled is greater than or equal to the preceding pre-established distance of sheet travel, but less than the next pre-established distance of sheet travel, or in formula form, $D_{x-1} \leqq D < D_x$, where $D_{x-1}$ is the preceding pre-established distance and $D_x$ is the next pre-established distance.

As discussed above, since a particular radius of curvature may be repeated during the sequence of steps during which varying radii of curvature are roll formed into the sheet of metal by the apparatus 10, more than one of the outputs on the lines 108', 108'', etc., may be directed to one of the inputs 112', 112'', etc., of the radius control and modification circuit 100 and thus to one of the channels thereof. As shown in FIG. 3, each channel or radius generating circuit 138', etc., is provided with a multiplicity of inputs to which more than one of the leads 110', 110'', etc., may be connected, thereby generating, in sequence (of course, not successive), repetition of a particular desired radius of curvature.

Shown in FIG. 4 is a typical channel 138'' for generating the current $I_{R2}$. It should be understood that each of the channels of the radius control and modification circuit 100 are identical, and therefore the circuitry illustrated in FIG. 4 is illustrative of each of the channels shown in block form in the radius control and modification circuit 100 in FIG. 3.

The output of the gate 142 is presented on the line 108'' and also on a line 144 through a resistor 146 to the base of a transistor 148. The emitter of the transistor 148 is grounded, while the collector of the transistor 148 is connected to a resistor 150 which in turn is connected to a light-emitting diode (LED) 152'' connected to a source of positive voltage V.

The line 108'' is connected by the lead 110'' to one of the input lines 112''. Each of the input lines is connected through a blocking diode 154 to a common junction 156. Connected to the junction 156 is a resistor 158 attached to the base of a transistor 160. The emitter of the transistor 160 is grounded, while the collector is connected to a resistor 162 which in turn is connected to an LED 164 energized by a source of positive voltage V.

The emitter of a transistor 166 is also connected to the junction 156. The base of transistor 166 is connected through a resistor 168 to ground, while the collector of transistor 166 is connected by a line 170 to a junction 172. A source of negative voltage V is connected to the junction 172 through a resistor 174. The junction 172 is also connected through a diode 176 to the gate of a field effect transistor (FET) 178. The diode 176 is also connected to a pull-up resistor 180. The pull-up resistor 180 is connected to the source of FET 178 and the two are connected by a precision resistor 182 to the slider of precision radius determining potentiometer 184''. The drain of the FET 178 is connected to the line 116 which in turn is connected to the summing junction 114 (FIG. 3).

The circuit of FIG. 4 functions as follows. When the gate 142 produces a high output, that output is directed to the base of the transistor 148, which begins to conduct. Therefore, the voltage V passes through the LED 152'' which glows, indicating that the gate 142 is producing a high output. At the same time, the high output of the gate 142 proceeds through the line 108'', through the lead 110'' to the input line 112'', and through the diode 154 to the junction 156. The positive voltage is therefore presented to the base of the transistor 160 which begins to conduct, causing a current I to flow through the LED 164. At the same time, the output at the junction 156 passes through the transistor 166 to the junction 172, reducing the negative voltage V presented through the resistor 174 and diode 176 to the gate of the FET 178. The FET 178 therefore begins to conduct. The FET acts as a switch which had previously been open. When it begins to conduct, this switch is closed causing a current $I_{R2}$, whose magnitude is dictated by the setting of radius potentiometer 184'', to be transmitted from the potentiometer 184 through precision resistor 182 and the FET 178 to the line 116. The current $I_{R2}$ may be varied depending on the setting of the slider of the radius potentiometer 184''.

Thus, when the gate 142 has a high output, the LED 152'' glows, indicating that there is an output on the line 108'' and that $D_1 \leqq D < D_2$. Also, the LED 64 glows, indicating that $I_{R2}$, dictated by the presetting of the potentiometer 184, is being generated by the radius control and modification circuit. None of the other currents $I_{R1}$ and $I_{R3}$ through $I_{RM}$ and $I_{RD}$ is being generated at this time, and, of course, no other outputs from the gating circuit 98 are likewise being generated.

By setting the position of the potentiometer 184'', the value of $I_{R2}$ is established. This current is representative of, for example, the second radius of curvature to be impressed into the sheet by the rolls 12, 14 and 16, and controls the position of the bending roll 16 by comparison to $I_R$ generated by the bending roll position indicating circuit 118 as detailed below. Thus, to change the desired radius of curvature dictated by the activation of this channel, the setting of the radius potentiometer is appropriately changed.

Returning to FIG. 3, the bending roll position indicating circuit 118 comprises an operational amplifier 186 having positive and negative supply voltages V and a feedback resistor connected between its output and its inverting input 188. Also connected to the inverting input 188 is the output of the potentiometer 62 along the line 68. The non-inverting input 190 of the operational amplifier 186 is grounded through a resistor 192.

The output of the indicating circuit 118 is connected on the line 192 to the summing junction 114. The summing junction 114 in turn is connected to the inverting input 194 of an operational amplifier 196 of the servo control 120. The non-inverting input 198 of the operational amplifier 196 is connected through a resistor 200 to ground.

For the operational amplifiers 186 and 196, the applicant has shown a model A741C high performance operational amplifier manufactured by Fairchild Semiconductor Corporation. It should be evident that other operational amplifiers may be substituted for those described.

The output 202 of the operational amplifier 196 is connected to the base of each of a pair of transistors 204 and 206. The collectors of the transistors 204 and 206 are connected to a positive and negative voltage V, respectively, while the emitters of the transistors 204 and 206 are connected to a coil 208 of the servo valve 58. Finally, a voltage indicative of the current through the coil 208 is fed back to the summing junction 114 through resistor 210, setting the system gain.

The bending roll position indicating circuit 118 and servo control circuit 120 operate as follows. Due to the location of the bending roll 116, precision potentiometer 62 provides a particular positive voltage which when applied to precision resistor 211 creates a current on output line 68. This output is directed to the inverting input 188 of the operational amplifier 186 where it is amplified and inverted, the output being a negative voltage. When that negative voltage is applied to precision resistor 213, it appears at a negative current $I_R$ on the line 192 which is presented to the summing junction 114. At the same time, a current $I_{RX}$, which is one of $I_{R1}$ through $I_{RM}$ or $I_{RD}$, is being presented to the summing junction 114 on the line 116. If $I_R$ is equal and opposite to $I_{RX}$, then the two currents are cancelled and no signal is presented to the inverting input 194 of the operational amplifier 196. Therefore, there is no output of the operational amplifier 196 and neither of the transistor amplifiers 204 or 206 is actuated, and consequently, no current flows through the coil 208. However, if $I_{RX}$ is greater than $I_R$, then a positive voltage is presented to the inverting input 194 of the operational amplifier 196. This input is amplified and inverted, presenting a negative voltage on the output line 202 which causes the transistor 206 to begin conducting. A current therefore passes through the coil 208 in one sense. Coil 108 and its armature (not shown) are the valve operator of servo valve 58, and as current flows through the coil 208 in this sense, the servo valve 58 allows hydraulic fluid to flow to the cylinder 52 in this sense of extending the piston. This causes arm 46 to raise and the voltage value output of the potentiometer 62 to increase. This increased voltage is presented on line 68 to the amplifier 186 which increases the negative value of $I_R$ on line 192. This process is repeated until the value of $I_R$ is raised sufficiently to be equal and opposite the value of $I_{RX}$ at which time zero input is presented to the operational amplifier 196 on the line 194, and therefore no current flows through the coil 208. Therefore, the system is at rest. Due to the size of the feedback resistor 210, the process of increasing the value of $I_R$ is relatively quick.

In addition, the size of the resistor 210 prevents any substantial overshoot of the absolute value of $I_R$ from that of $I_{RX}$. Therefore, in operation, as soon as $I_R$ and $I_{RX}$ are unequal, the position of the bending roll 16 is immediately altered so that the system will again be at rest and the value of the current $I_R$ on line 192 will be equal and opposite to that of the current $I_{RX}$ on line 116. When the bending roll is to be lowered, for example to produce a lesser degree of curvature, $I_{RX}$ is made less than $I_R$ and a negative voltage appears at inverting input 194. The positive voltage then appearing on line 202 causes transistor 204 to conduct, the result being that current flows through coil 208 in the other sense and valve 58 produces hydraulic fluid flow in the sense of retracting the piston of cylinder 52. Of course, $I_R$ is adjusted in the manner just described.

The latch and delay 122, as shown in FIG. 3, includes a latch portion, generally 212, and a delay portion, generally 214.

The portion 212 includes a starting push button switch 216 connected to one input of an inverting input OR-gate 218. The output of the gate 218 is connected to one input of a second inverting input OR-gate 220 whose output is connected to one of the inputs of the gate 218 and each of the gates 134, 142, etc. of the gating circuit 98.

The delay portion 214 is of conventional design and, as primary components, includes a pair of cross-connected transistors 222 and 224 and a time delay capacitor 226. The delay portion 214 receives an input on line 228 coming from a final AND-gate 230 attached to the final comparator $C_N$.

The operation of the latch is as follows. On power turn-on capacitor 231 has been discharged and thus presents a low voltage to the input of gate 220 for a short time. This causes the output of OR-gate 220 to be high. Since this output is connected to one input of gate 218 and since the other input 232 is high, gate 218 has a low output. The high output of gate 220 inhibits operation of the gating circuit 98. Therefore, the output of the gates 134, 142, etc. and gate 230 will be low.

When the push button 216 is depressed, the input 232 of the gate 218 is momentarily drawn low. This causes the output of the gate 218 to be high and therefore the output of the gate 220 goes low, enabling operation of the gating circuit 98. At the same time, depression of the switch 216 grounds a line 234 which is attached to the zero or clearing function of the counter 92. Therefore, the counter is reset and operation of the circuitry of the control mechanism 90 is enabled. The circuitry then operates as described above.

When the final comparison in the comparator $C_N$ indicates that the final pre-established distance $D_N$ has been reached, the output of the gate 230 goes high. This signal is carried on line 228 to the base of transistor 222 which then begins to conduct. At the same time, cross-connected transistor 224, which had been conducting, ceases to conduct. Capacitor 226 then begins to charge. After a determined length of time in which capacitor 226 is charged, the charging time of which is dictated by the resistance of the delay portion 214, hence establishing the delay of the delay portion, the transistor 224 begins to conduct, momentarily drawing input line 236 of the gate 220 low, thereby causing the output of the gate 220 to be high, inhibiting operation of the gating circuit 98. Therefore, operation of the control mechanism 90 is inhibited until the pushbutton switch 216 is again depressed.

When the output of the gate 220 is high, it is also directed over inhibit line 121 to a down radius control circuit 238 of the radius control and modification circuit 100, which operates in precisely the same manner as the radius control circuit shown in FIG. 4. A current $I_{RD}$ is generated of sufficient magnitude to cause the servo valve 58 to lower the cylinder 52, backing the bending roll 16 away from the pinch rolls 12 and 14. Thus, the now-formed sheet is subjected to no further formation, and may be removed from the apparatus 10 as described above.

The purpose of the delay of the delay portion 214 is to allow the end of a sheet of metal to pass the wheel 78 and proceed through the pinch rolls 12 and 14 as the sheet is being shaped by the bending roll 16. Were there no delay, as soon as the counter 92 indicates that $D_N$ is reached, the control mechanism 90 would be inhibited and the bending roll 16 immediately backed away from the pinch rolls 12 and 14 before the trailing end of the sheet had been formed.

Figure 5:
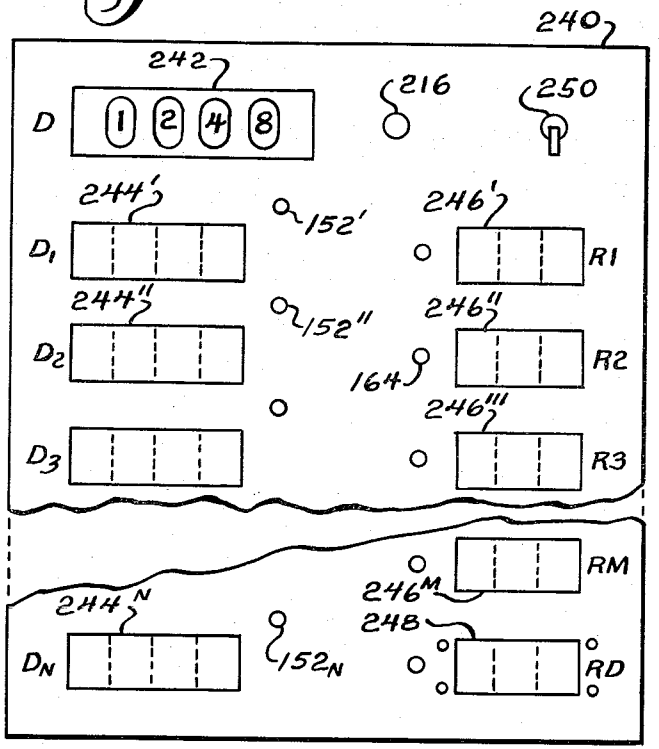
FIG. 5 is a front elevational illustration of a control panel for the control circuitry of the invention.

FIG. 5 pictorially represents one form which a control panel 240 for controlling and setting values of actual distance and desired radii of curvature may be set. The panel 240 includes the push button starting switch 216 and a digital display 242 for displaying the actual distance D as generated by the counter 92 (FIG. 2). Also included in the panel 240 on the left thereof are digital distance controls 244' through 244$^N$, i.e., thumbswitches for pre-setting the pre-established distances $D_1$ through $D_N$. Adjacent each of the controls 244' through 244$^N$ are a series of light emitting diodes 152, 152', 152'', etc. Diode 152 is on when the actual distance travelled is less than $D_1$ which has been set into control 244'. When the distance is greater than $D_1$, but less than $D_2$, LED 152' is lit, and so forth for the remainder.

On the right side of the panel 240 are located a series of radius controls 246'–246$^M$, the thumbswitches of which are not illustrated. These radius controls correspond respectively to the radius control potentiometers 184'–184$^M$ of FIGS. 2 and 4. Adjacent each of the controls 246' through 246$^M$ are light-emitting diodes which indicate which particular selected radius of curvature is being impressed in the sheet at a particular time. LED 164, also shown in FIG. 4, is indicated by number in FIG. 5.

As indicated above, more than one radius of curvature may be repeated upon reaching a certain of the distances $D_1$ through $D_N$, depending on the particular sheet contour desired. Therefore, as each of the LED's adjacent the displays 244' through 244$^N$ are sequentially illuminated as the pre-established distances $D_1$ through $D_N$ are reached, one of the LED's adjacent the radius controls 246' through 246$^M$ will be illuminated. For example, in the formation of pipe arch as discussed above, if R1 on the panel 240 represents $R_t$, R2 represents $R_b$ and R3 represents $R_c$, then the light-emitting diode adjacent control 246''' will be illuminated twice during formation of pipe arch, while the LED adjacent each of at least four of the controls 244' through 244$^N$ will each be illuminated once.

Also contained on the panel 240 is a control 248 on which will set the final down radius RD which controls the final withdrawal of the bending roll 16 after the final distance $D_N$ has been traversed, as described above.

The panel 240 may contain other displays and switches as needed. As illustrated in FIG. 5, the panel 240 also includes a power switch 250 for connecting power to the control mechanism 90 and, if desired, the motor used for rotating the rolls 12 through 16.

We claim:

1. A roll forming apparatus for curling a sheet of metal into a curved configuration having a plurality of sheet contours each in a respective segment of said sheet, the apparatus including a pair of pinch rolls and a bending roll for curving the sheet into predetermined arcs dependent upon the relative positions of the bending and pinch rolls, and power means for varying the relative positions of the bending and pinch rolls, said apparatus being characterized by:

measuring means responsive to the movement of the sheet through the roll forming apparatus and to generate progressive signals indicative of the extent of that movement; and control means connected to said measuring means and to said power means for determining from said progressive signals which segment of the sheet is in the appropriate position for bending between the pinch and bending rolls and for causing said power means to establish said relative positions of the pinch and bending rolls to produce the desired contour for that segment, said control means comprising command value generator means to produce command value signals related to the distances of travel for the segments respectively, comparator means connected to receive the signals from the measuring means and the command value generator means for comparing said signals and for producing a further signal when a distance corresponding to the end of the segment being rolled and the beginning of the next successive segment is reached, and radius control and modification means connected to receive said further signal for producing a signal to the power means indicative of the relative positions of the pinch and bending rolls for said next successive segment.

2. A roll forming apparatus according to claim 1 in which said measuring means includes a wheel bearing against the sheet as it proceeds through the apparatus, an encoder connected to the said wheel, and counting means connected to said encoder, said counting means including means to generate said signal indicative of the actual distance the sheet has travelled.

3. A roll forming apparatus according to claim 1 in which said comparator means includes a separate comparator associated with the distance of sheet travel for each segment respectively, each said comparator being connected to receive the command value signals associated with the respective segment, each said comparator comparing its command value signals to said signal indicative of the actual distance the sheet has travelled.

4. A roll forming apparatus according to claim 3 in which each said comparator produces three output signals, one of said output signals indicative of the actual distance being less than the distance of its command value signal, the second said output signals indicative of the actual distance being equal to the distance of its command value signal, and the third said output signals indicative of the actual distance being greater than the distance of its command value signal.

5. A roll forming apparatus according to claim 4, including gating circuit means connected to said comparator means and having a plurality of outputs, said gating circuit means producing signals at said outputs successively as the actual distance the sheet has travelled successively comes to be the distances established by the command value generator means, wherein said radius control and modification means comprises a plurality of channels each having a respective input and all having a common output, each channel including means for producing a signal at the common output indicative of a particular radius of curvature when a signal is applied to the respective input, including means for selectively coupling said channel inputs to said gating means outputs, and including means connecting said common output to said power means for establishing said relative positions of the pinch and bending rolls as dictated by the signal at said common output.

6. A roll forming apparatus according to claim 1 including gating circuit means connected between said comparator means and said radius control and modification means, said gating circuit means including means to initially generate a constant output signal and to change said constant output signal each time the actual distance the sheet has progressed equals one of said pre-established distances of sheet travel.

7. A roll forming apparatus according to claim 6 including position sensing means connected to at least one of said rolls to produce a signal indicative of the relative positions of said pinch and bending rolls, and wherein said control means includes means connected to said position sensing means and to said radius control and modification means to compare the signals therefrom and to produce an additional signal, and means connecting the last mentioned means and the power means for setting the relative positions of the bending and pinch rolls in response to said additional signal.

8. A roll forming apparatus according to claim 7 wherein said power means includes a hydraulic cylinder and a servo valve connected to said hydraulic cylinder, said servo valve being connected to be responsive to said further signal to activate said hydraulic cylinder.

9. A roll forming apparatus according to claim 6 including means connected to said gating circuit to inhibit generation of said constant output signals subsequent to the actual distance equaling a final and largest desired value of distance of sheet travel.

10. A roll forming apparatus according to claim 9 including means to delay inhibition of said constant output signals for a predetermined period of time after the actual distance equals the final and largest desired value of pre-established distance of sheet travel.

11. A roll forming apparatus according to claim 1, including gating circuit means connected to said comparator means and having a plurality of outputs, said gating circuit means producing signals at said outputs successively as the actual distance the sheet has travelled successively comes to be the distances established by the command value generator means, wherein said radius control and modification means comprises a plurality of channels each having a respective input and all having a common output, each channel including means for producing a signal at the common output indicative of a particular radius of curvature when a signal is applied to the respective input, including means for selectively coupling said channel inputs to said gating means outputs, and including means connecting said common output to said power means for establishing said relative position of the pinch and bending rolls as dictated by the signal at said common output.

12. A roll forming apparatus according to claim 11 in which each of said channels includes a voltage generator including an electronic switch connected to a source of preselected voltage.

13. A roll forming apparatus according to claim 1 including position sensing means connected to at least one of said rolls to produce a signal indicative of the relative positions of said pinch and bending rolls, and wherein said control means includes means connected to said position sensing means and to said radius control and modification means to compare the signals therefrom and to produce an additional signal, and means connecting the last mentioned means and the power means for setting the relative positions of the bending and pinch rolls in response to said additional signal.

14. A roll forming apparatus as set forth in claim 13 and wherein one of said pinch rolls includes an adjusting mechanism for adjusting the spacing between the pinch rolls to accommodate sheets of different thicknesses, said apparatus being further characterized by:

said position sensing means comprising a body member having a resistor and a slider member positionable along said resistor, one of said members being normally fixed and the other of said members being movable with respect thereto;

means operatively connecting said other member and said one of said rolls for moving said other member in response to the positioning movement of said one roll; and means operatively connecting said one member and said adjusting mechanism for moving said one member with respect to the other member in response to a spacing adjustment of the pinch rolls.

15. A roll forming apparatus for curling a sheet of metal into a curved configuration having a plurality of sheet contours each in a respective segment of said sheet, the apparatus including a pair of pinch rolls and a bending roll for curving the sheet into predetermined arcs dependent upon the relative positions of the bending and pinch rolls, and power means for varying the relative positions of the bending and pinch rolls, said apparatus being characterized by:

radius control means, and means connecting the radius control means to said power means for establishing said relative positions as dictated by a signal from the radius control means, said radius control means including a plurality of channels, each channel having an input, an output, an adjustable command generator means and means connecting said input and output to the command generator means, said command generator means producing a radius control signal at the output of the respective channel when a signal is applied to the input of that channel, said radius control signal having a characteristic which is varied as said command generator means is adjusted to thereby render the signal indicative of a different radius, said connecting means being connected to each of said outputs;

measuring and control means responsive to the movement of the sheet through the roll forming apparatus and including a plurality of outputs, said measuring and control means determining which of a plurality of said segments is in position to be curved by the apparatus and producing a signal at a respective output thereof depending upon which segment is so positioned; and means for connecting the outputs of the measuring and control means with channel inputs of the radius control means;

whereby as each segment is in a position to be curved said measuring and control means produces a signal at a respective output thereof which signal upon receipt by a channel of the radius control means causes the command generator means of that channel to produce a radius control signal at the output of that channel.

16. A roll forming apparatus as set forth in claim 15, wherein said bending roll has a plurality of longitudinal slots in the periphery thereof to facilitate the starting of a sheet through the apparatus.

* * * * *